United States Patent [19]

Schulz

[11] 4,444,080

[45] Apr. 24, 1984

[54] TOOL FOR MAKING ROWS OF PERFORATIONS IN PAPER WEBS OR THE LIKE

[75] Inventor: Helmut Schulz, Schopfheim, Fed. Rep. of Germany

[73] Assignee: Grapha-Holding AG, Hergiswil, Switzerland

[21] Appl. No.: 331,929

[22] Filed: Dec. 17, 1981

[30] Foreign Application Priority Data

Jan. 9, 1981 [CH] Switzerland ..... 119/81

[51] Int. Cl.[3] ..... B26D 1/20

[52] U.S. Cl. ..... 83/660; 83/346; 83/348; 83/678

[58] Field of Search ..... 83/678, 695, 697, 674, 83/332, 346, 345, 348, 349, 660

[56] References Cited

U.S. PATENT DOCUMENTS

| | | | |
|---|---|---|---|
| 461,600 | 10/1891 | West | 83/348 |
| 2,870,840 | 1/1959 | Kwitek | 83/678 X |
| 3,709,077 | 1/1973 | Trogan et al. | 83/345 X |
| 3,828,637 | 8/1974 | Slack | 83/348 |
| 4,010,666 | 3/1977 | Masters | 83/678 |
| 4,370,908 | 2/1983 | De Alto et al. | 83/348 |

*Primary Examiner*—Frank T. Yost
*Attorney, Agent, or Firm*—Peter K. Kontler

[57] ABSTRACT

A tool which is used to make rows of perforations in a running web of paper or the like has a rotary holder and a flat blade which is removably secured to the holder so that one of its longitudinal edge faces extends beyond the periphery of the holder. Such one longitudinal edge face has a row of perforating teeth and the blade has an elastically deformable portion which extends lengthwise of the one longitudinal edge portion to enable at least some of the perforating teeth to yield if they engage a hard surface while the row of teeth bulges outwardly in the region between the ends of the one longitudinal edge face. The elastically deformable portion can have one or more rows of slots or one or more corrugations. If the elastically deformable portion has two rows of slots, the slots in the row which is nearer to the perforating teeth partially overlap the neighboring slots of the adjacent row. The elastically deformable portion contributes to longer useful life of the blade because it enables some or all of the perforating teeth to yield in response to stresses which act against the one longitudinal edge face in a direction toward the other longitudinal edge face or vice versa.

11 Claims, 7 Drawing Figures

TOOL FOR MAKING ROWS OF PERFORATIONS IN PAPER WEBS OR THE LIKE

BACKGROUND OF THE INVENTION

The present invention relates to apparatus for making rows of perforations in webs which consist of paper, metallic foil, plastic foil or other sheet or strip material. More particularly, the invention relates to improvements in perforating tools which can be utilized in such apparatus. Still more particularly, the invention relates to improvements in blades which are utilized in perforating tools to make rows of slits, slots, holes or otherwise configurated perforations in running or stationary webs of paper or the like.

It is already known to assemble the perforating tool in an apparatus for perforating webs of paper or the like of a removable blade and a rotary holder for the blade. One longitudinal edge face of the blade has a row of perforating teeth in the form of triangular, square, rectangular or otherwise configurated projections which penetrate into a web once during each revolution of the holder. As a rule, the blade is made of sheet steel stock. The mounting of the blade in or on its holder is such that the teeth extend beyond the periphery of the holder so that they can penetrate into or otherwise deform or weaken a web which is caused to pass through the nip of the rotary holder with a suitable anvil, e.g., a counterroller against which the tips of the teeth abut when the one longitudinal edge face of the blade is caused to advance through the nip. The peripheral surface of the counterroller is normally hardened. When properly installed in the perforating apparatus, the holder for the blade and the counterroller are caused to bear against each other. The blade is disposed radially of the holder and its teeth bear against the periphery of the counterroller whenever the blade advances toward, past and beyond the aforementioned nip. The fact that the holder and the counterroller bear against each other entails at last some flexing of such components.

It has been found that, when a perforating apparatus of the above outlined character is in actual use, the extent of flexing of the holder and/or of the counterroller decreases with increasing RPM of the holder. This, in turn, entails a more pronounced and more rapid wear upon those perforating teeth which are located substantially midway between the axial ends of the holder, i.e., midway between the transverse edge faces of the blade. In other words, while the teeth which are adjacent to the two axial ends of the holder are still of acceptable size and shape, the size and/or shape of teeth in the region of the center of the holder deviates considerably from the original size and/or shape. Consequently, when the RPM of the holder is reduced and the flexural stresses upon the holder and the counterroller increase, the centrally located perforating teeth remain out of contact with the web or fail to penetrate all the way through the web so that the rows of perforations are interrupted or the perforations at the center of each row are less pronounced that those in the regions of the two marginal portions of the web. Thus, while the end portions of perforated zones of the web offer a relatively low resistance to tearing or flexing, the median portions of such perforated zones offer a much more pronounced resistance to deformation or breakage because the perforations in the median portions are less pronounced or are absent in their entirety. This can create numerous problems during further processing of the web.

OBJECTS AND SUMMARY OF THE INVENTION

An object of the invention is to provide a perforating apparatus which can ensure predictable formation of rows of perforations in a web of paper or the like irrespective of the speed of the perforating tool or tools.

Another object of the invention is to provide the perforating apparatus with a perforating tool whose blade is constructed and configurated in such a way that its perforating teeth undergo uniform wear at a relatively high or at a relatively low RPM of the holder wherein the blade is installed.

A further object of the invention is to provide a novel and improved blade for use in a perforating tool of the above outlined character.

An additional object of the invention is to provide the blade with means which ensure that the centrally located perforating teeth cannot, or are less likely to, undergo more pronounced wear when the speed of the tool holder is increased.

An ancillary object of the invention is to provide a novel and improved blade which can be used in heretofore known perforating tools and perforating apparatus as a superior substitute for conventional perforating blades.

A further object of the invention is to provide a blade whose useful life greatly exceeds the useful life of heretofore known perforating blades.

An additional object of the invention is to provide a relatively simple, inexpensive and wear-resistant blade which can be mass-produced in available machines.

The invention resides in the provision of a tool which can be utilized to make rows of perforations (elongated slots, round or oval holes and/or slits) in webs consisting of paper or the like (e.g., in running paper webs which are to be weakened by rows of transversely extending perforations in order to facilitate separation of successive web portions from each other or to facilitate predictable folding of the web along the rows of perforations). The tool comprises a preferably flat blade consisting of spring steel or the like and having preferably parallel or nearly parallel first and second longitudinal edge faces, preferably parallel first and second transverse edge faces, a row of perforating teeth (in the form of triangular, rectangular, square or otherwise configurated protuberances) extending along the first longitudinal edge face of the blade, and an elastically deformable portion extending lengthwise of the first longitudinal edge face and between the first and second longitudinal edge faces so as to enable at least some of the teeth to yield in response to the application of stresses acting against one of the longitudinal edge faces in a direction toward the other of the longitudinal edge faces. The ends of the elastically deformable portion can extend all the way to the two transverse edge faces, or at least one of the two ends of the elastically deformable portion can terminate short of the respective transverse edge face. For example, the elastically deformable portion of the blade can be located midway between the transverse edge faces so that at least the centrally located perforating teeth can yield when they are caused to bulge in a direction away from the other longitudinal edge face and are caused to abut against a complementary surface, e.g., against an anvil which cooperates with the tool to make perforations in a running paper web or the like.

The elastically deformable portion can be provided with at least one row of openings which extend lengthwise of the longitudinal edge faces. For example, the elastically deformable portion can comprise several rows of openings which extend lengthwise of the longitudinal edge faces and include a first and a second row of openings. The openings of the first row (e.g., the openings which are nearer to the first longitudinal edge face of the blade) are or can be staggered with reference to the openings of the second row of openings. For example, the openings of the first row can partially overlap the neighboring openings of the second row. The arrangement may be such that each opening of the first row of openings partially overlies at least one of the two neighboring openings forming the second row of openings. The openings may constitute elongated slots extending in the longitudinal direction of the first longitudinal edge face of the blade.

Alternatively, the elastically deformable portion of the blade can comprise at least one elongated corrugation extending lengthwise of the first longitudinal edge face. Such corrugation can have a flute in one side face of the blade and a ridge extending beyond the other side face of the blade. The length of the corrugation can approximate the distance between the first and second transverse edge faces of the blade. The same can hold true if the elastically deformable portion consists of or includes one or more rows of slots, circular holes or otherwise configurated openings.

The novel features which are considered as characteristic of the invention are set forth in particular in the appended claims. The improved tool itself, however, both as to its construction and the mode of utilizing the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
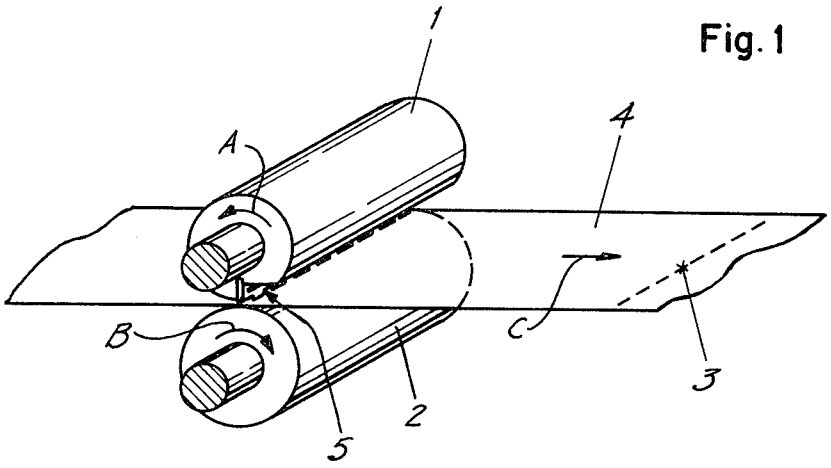
FIG. 1 is a fragmentary perspective view of a perforating apparatus including a tool which embodies one form of the present invention.

Referring first to FIG. 1, there is shown a portion of a perforating apparatus which serves to make spaced-apart rows of transversely extending perforations 3 (e.g., slits, slots or holes) in a running web 4 of paper or the like. The web 4 is caused to advance through the nip of a driven substantially cylindrical holder 1 and a parallel counterroller or anvil 2 which may but need not be driven. The directions in which the holder 1 and the counterroller 2 rotate when the perforating apparatus is in use (i.e., when the web 4 advances in the direction of arrow C) are respectively indicated by arrows A and B.

Figure 2:
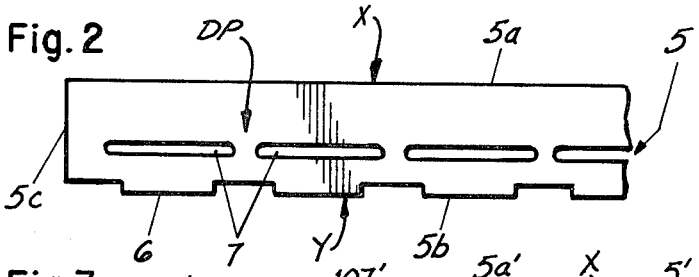
FIG. 2 is a fragmentary side elevational view of the blade in the perforating tool of FIG. 1, the elastically deformable portion of this blade having a single row of elongated slot-shaped openings.
Figure 5:
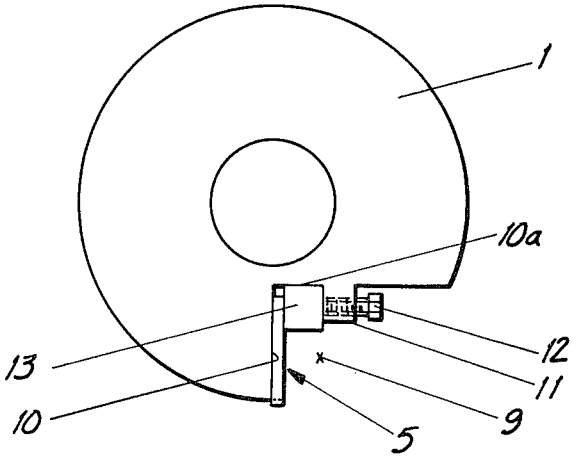
FIG. 5 is an enlarged end elevational view of the perforating tool which is shown in the upper portion of FIG. 1.

The holder 1 supports a separable perforating blade 5 (hereinafter called blade for short) which can consist of spring steel and is installed in a substantially semisegmental recess 9 machined into the periphery of the holder 1 (see FIG. 5). The latter has a radially extending shoulder 10 against which the corresponding side face of the blade 5 abuts, and the other side face of the blade 5 is urged toward the shoulder 10 by several equidistant screws 12 which mesh with an axially parallel projection or rib 11 of the holder 1 and whose tips bear against one or more inserts 13 which, in turn, abut against the other side face of the blade. As can be seen in FIG. 2, the blade 5 has a first longitudinal edge face 5*b* which has a row of perforating teeth 6 extending beyond the peripheral surface of the holder 1, and a second longitudinal edge face 5*a* which abuts against a second shoulder 10*a* in the recess 9 of the holder 1 when the blade 5 is properly installed and held by the insert or inserts 13. The number and configuration of perforations in the rows of perforations 3 in the web 4 depends on the number and configuration of perforating teeth 6 at the edge face 5*b* of the blade 5.

The edge faces 5*a* and 5*b* are at least substantially parallel to each other and extend all the way between two transverse edge faces 5*c* of which only one can be seen in FIG. 2. In accordance with a feature of the invention, the blade 5 has an elastically deformable portion DP which has a single row of elongated slot-shaped openings 7 extending in parallelism with the longitudinal edge face 5*b* and enabling the teeth 6 to yield in response to the application of stresses in the direction of arrow X or Y, i.e., in response to the application of stresses acting against one of the longitudinal edge faces 5*a*, 5*b* in a direction toward the other longitudinal edge face and/or vice versa. The row of openings 7 can extend along the full length of the edge face 5*b* or along the major portion of such edge face. In the embodiment of FIG. 2, at least that end of the weakened or elastically deformable portion DP which is nearer to the illustrated left-hand transverse edge face 5*c* terminates short of this transverse edge face. In many instances, it suffices if the openings 7 are provided in the central portion of the blade 5, namely, in the portion which is located midway between the two transverse edge faces 5*c* and is spaced apart from each such transverse edge face. Each of the illustrated slot-shaped openings 7 is in register with a discrete tooth 6, and the length of each opening 7, as considered in the longitudinal direction of the edge face 5*b*, exceeds the length of the respective (aligned or registering) tooth 6. The openings 7 weaken the respective regions of the deformable portion DP so that the teeth 6 can yield to stresses acting in the direction of arrow Y with attendant elastic deformation of the corresponding region of the portion DP. The teeth 6 can be said to constitute bridges of metallic material in front of the respective openings or slots 7. The aforementioned stresses can develop when the holder 1 is driven at a high speed while the row of teeth 6 repeatedly advances through the nip of the holder 1 and counterroller 2. In the absence of the ability of teeth 6 to yield in response to stresses acting in the direction of the arrow Y, the tips of teeth 6 would fail to form satisfactory (or any) perforations when the RPM of the holder 1 is thereupon reduced. The reasons for such behavior of teeth 6 in the absence of openings 7 will be readily appreciated upon perusal of the preceding description. As also mentioned above, the likelihood of pronounced and rapid wear upon the teeth 6 is especially great in the region substantially midway between the two transverse edge faces 5*c* of the blade 5; therefore, it is advisable to provide openings 7 at least in the median portion of the blade 5.

Figure 3:
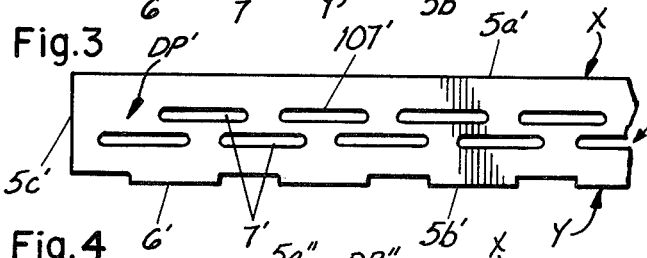
FIG. 3 is a similar fragmentary side elevational view of a second blade wherein the elastically deformable portion has several rows of elongated slot-shaped openings.
Figure 3A:
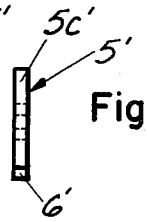
FIG. 3*a* is an end elevational view of the blade which is shown in FIG. 3.

The blade 5' of FIGS. 3 and 3*a* has an elastically deformable portion DP' which extends substantially but not entirely all the way between the two transverse edge faces 5*c'* (only one shown) and has several rows of elongated slot-shaped openings including a first row of openings 7' nearer to the teeth 6' and a second row of openings 107' nearer to the longitudinal edge face 5*a'*. The latter is parallel to the longitudinal edge face 5*b'* which is formed with the perforating teeth 6'. The openings 107' register with the corresponding teeth 6', and the openings 7' are staggered with reference to the neighboring openings 107', i.e., at least one end portion of each opening 7' overlies a portion of the neighboring opening 107'. The elastically deformable portion DP' exhibits a highly pronounced deformability or yieldability in response to stresses which are applied in the direction of arrow X and/or Y.

An advantage of the blades 5 and 5' is that the openings 7, 7' and 107' can be formed with a very high degree of accuracy by resorting to a suitable stamping machine. Thus, the configuration and dimensions of each opening can match the configuration and dimensions of each other opening in the same row (the openings 7' can but need not be identical with the openings 107'). Uniformity of openings 7, 7' or 107' contributes to uniformity of quality of the blades and of the perforating operation. Furthermore, the weight of the blades 5 and 5' is reduced because the stamping operation involves removal of material from the blanks which are converted into blades 5 or 5'.

Figure 4:
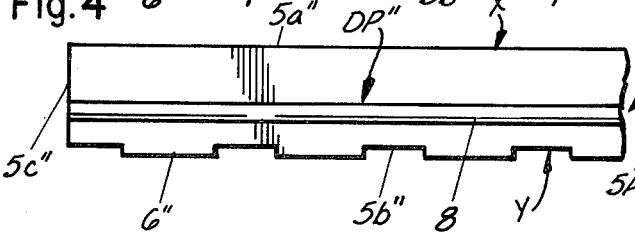
FIG. 4 is a fragmentary side elevational view of a third blade wherein the elastically deformable portion has an elongated corrugation.
Figure 4A:
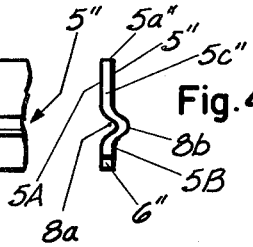
FIG. 4*a* is an end elevational view of the blade which is shown in FIG. 4.

FIGS. 4 and 4*a* illustrate a third blade 5'' with a row of perforating teeth 6'' in the longitudinal edge face 5*b'*, a straight longitudinal edge face 5*a''* which is parallel with the edge face 5*b''*, two transverse edge faces 5*c''* (only one shown), two side faces 5A and 5B, and an elastically deformable portion DP'' which is parallel to the edge faces 5*a''*, and extends all the way between the two edge faces 5*c''*. The deformable portion DP'' has at least one elongated corrugation 8 having a flute or recess 8*a* in the side face 5A and a ridge or bead 8*b* in the side face 5B. When the blade 5'' is subjected to the action of forces as indicated by the arrow X or Y, the portion DP'' yields and enables the corresponding teeth 6'' to move nearer to the edge face 5*a''*. The spring characteristic of the portion DP'' can be readily selected according to need, e.g., by changing the depth of the flute 8*a*, by changing the number of corrugations 8, by changing the thickness of the material between each flute 8*a* and the exposed surface of the respective ridge 8*b* and/or by a combination of such parameters. If the blade 5'' has two or more corrugations 8, such corrugations are preferably parallel to each other and to the edge faces 5*a''*, 5*b''*. It is also possible to provide a blade with an elastically deformable portion having one or more rows of openings and one or more corrugations.

It is further possible to provide the blade 5, 5' or 5'' with two rows of perforating teeth 6, 6' or 6''. One row is caused to abut against the surface or shoulder 10*a* while the other row is in use, and vice versa. This can be useful to further prolong the useful life of the blade.

The elastically deformable portion DP'' does not contribute to a reduction of the weight of the blade 5''. However, this blade exhibits the aforementioned advantage that the elasticity of the portion DP'' can be readily adjusted or varied by the simple expedient of changing the depth of the flute or flutes 8*a*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A tool for making rows of perforations in webs consisting of paper or the like, comprising a blade having first and second longitudinal edge faces, a row of perforating teeth extending along said first edge face, first and second transverse edge faces, and an elastically deformable portion extending lengthwise of and between said longitudinal edge faces so as to enable at least some of said teeth to yield in response to the application of stresses acting against one of said longitudinal edge faces in a direction toward the other of said longitudinal edge faces, said deformable portion having first and second ends at least one of which is spaced apart from the respective transverse edge face.

2. The tool of claim 1 wherein said blade consists of spring steel.

3. The tool of claim 1, wherein said elastically deformable portion is disposed substantially midway between said transverse edge faces.

4. A tool for making rows of perforations in webs consisting of paper or the like, comprising a blade having first and second longitudinal edge faces, a row of perforating teeth extending along said first edge face, and an elastically deformable portion extending lengthwise of and between said edge faces so as to enable at least some of said teeth to yield in response to the application of stresses acting against one of said edge faces in a direction toward the other of said edge faces, said deformable portion having at least one row of openings extending lengthwise of said edge faces.

5. A tool for making rows of perforations in webs consisting of paper or the like, comprising a blade having first and second longitudinal edge faces, a row of perforating teeth extending along said first edge face, and an elastically deformable portion extending lengthwise of and between said edge faces so as to enable at least some of said teeth to yield in response to the application of stresses acting against one of said edge faces in a direction toward the other of said edge faces, said deformable portion having several rows of openings extending lengthwise of said edge faces, said rows of openings including a first row and a second row and the openings of said first row being staggered with reference to the openings of said second row, as considered in the longitudinal direction of said edge faces.

6. The tool of claim 5, wherein the openings of said first row partially overlap the neighboring openings of said second row.

7. The tool of claim 6, wherein the openings of at least one of said rows of openings are elongated slots extending in the longitudinal direction of said longitudinal edge faces.

8. The tool of claim 5, wherein each opening of said first row of openings partially overlaps at least one neighboring opening of said second row of openings.

9. The tool of claim 8, wherein said first row of openings is nearer to said first longitudinal edge face than said second row of openings.

10. A tool for making rows of perforations in webs consisting of paper or the like, comprising a blade having first and second longitudinal edge faces, a row of perforating teeth extending along said first edge face, and an elastically deformable portion extending lengthwise of and between said edge faces so as to enable at least some of said teeth to yield in response to the application of stresses acting against one of said edge faces in a direction toward the other of said edge faces, said deformable portion having at least one elongated corrugation extending lengthwise of said edge faces.

11. The tool of claim 10, wherein said blade has a first and a second side face and said corrugation has a flute in one of said side faces and a ridge extending beyond the other of said side faces.

* * * * *